United States Patent [19]

Porter

[11] Patent Number: 4,755,689

[45] Date of Patent: Jul. 5, 1988

[54] ELECTRIC STARTING SYSTEM

[75] Inventor: Philip J. Porter, Leonard, Mich.

[73] Assignee: General Motors Corporation, Detroit, Mich.

[21] Appl. No.: 104,960

[22] Filed: Oct. 6, 1987

[51] Int. Cl.[4] ..... F02N 11/00

[52] U.S. Cl. ..... 290/38 R; 123/179 R

[58] Field of Search ..... 290/38 R, 38 B, 46, 290/48, DIG. 1, DIG. 3; 74/617 A, 7 R; 123/179 R, 179 B

[56] References Cited

U.S. PATENT DOCUMENTS

| | | | |
|---|---|---|---|
| 2,542,712 | 2/1951 | Schneider et al. | 290/38 R |
| 3,433,968 | 3/1969 | Broyden | 290/38 R |
| 3,609,383 | 9/1971 | Welsh | 290/38 R |
| 3,866,960 | 2/1975 | Chohan | 290/38 R |
| 4,305,002 | 12/1981 | Mortensen | 290/38 R |
| 4,418,289 | 11/1983 | Mortensen | 290/38 R |
| 4,551,630 | 11/1985 | Stahura et al. | 290/38 R |
| 4,586,467 | 5/1986 | Raver | 123/179 B |

*Primary Examiner*—Vit W. Miska

*Attorney, Agent, or Firm*—C. R. Meland

[57] ABSTRACT

An electric starting system for cranking an internal combustion engine that utilizes a starter having a solenoid that is provided with pull-in and hold-in coils. The solenoid includes a plunger which when shifted operates solenoid switch contacts and shifts a pinion into mesh with the ring gear of the engine to be cranked. The solenoid switch contacts are not closed until the pinion is meshed with the ring gear. The electric starting motor is connected in series with the pull-in coil of the solenoid and when energized causes the armature of the motor to rotate slowly prior to the time that the pinion is meshed with the ring gear. The hold-in coil is not energized until the gears are meshed, which may be just prior to the solenoid switch closure to apply full power to the motor.

2 Claims, 1 Drawing Sheet

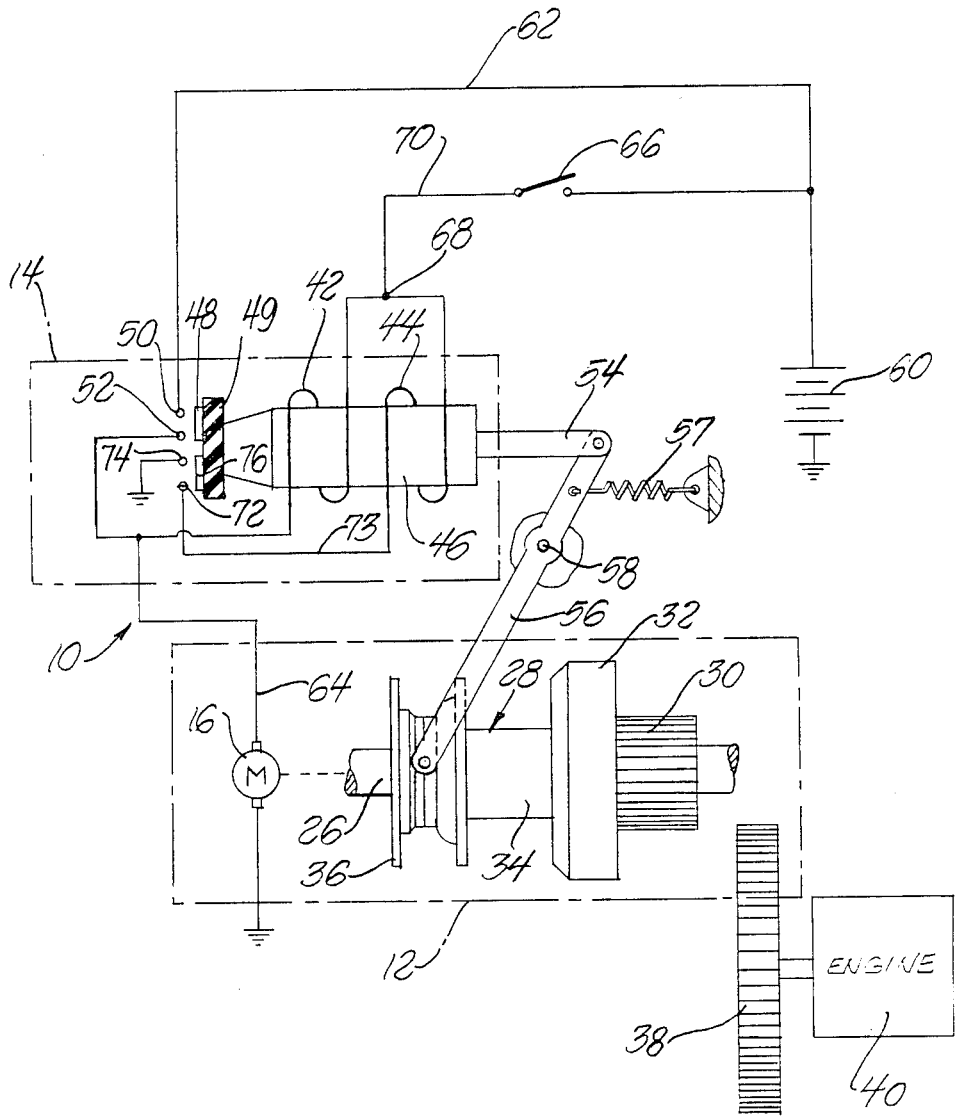
62
70
66
68
14
42
48
49
44
50
52
54
60
57
74
76
72
73
46
58
56
32
10
64
28
30
16
M
26
36
34
12
ENGINE
38
40

ELECTRIC STARTING SYSTEM

This invention relates to an electric starting system for cranking an internal combustion engine.

One known type of electric starter, for cranking an internal combustion engine, utilizes a solenoid that has a plunger which is connected to a pinion by a shift lever. The solenoid has hold-in and pull-in coils which, when energized, cause the plunger to be shifted to cause the pinion to mesh with the ring gear of the engine and movement of the plunger also causes a shiftable contactor to engage fixed contacts of a solenoid switch to energize the electric cranking motor and thereby rotatably drive the pinion.

When the pinion of the starting apparatus is moved toward a meshed condition with the ring gear it is possible for the end of the teeth of the pinion to abut or engage the end of the teeth of the ring gear (end tooth abutment) to prevent meshing of the pinion with the ring gear. In certain types of starting apparatus there is a so-called jump spring which is located between a starter drive shift collar and the pinion. The spring is compressed when end tooth abutment occurs and the compression of the spring allows the solenoid plunger to move the solenoid contactor into engagement with the fixed contacts of the solenoid switch to thereby energize the cranking motor at full power to in turn cause rotation of the motor armature and pinion driven thereby. When full power is applied to the cranking motor, due to closure of the solenoid switch, acceleration of the motor armature to cranking speed occurs and the pinion may be rotated so fast as to not become properly meshed with the ring gear thereby causing damage to the teeth of the pinion and/or ring gear. It accordingly would be desirable to provide a starting motor system where the pinion is rotated slowly prior to being moved by the solenoid into meshing engagement with the ring gear of the engine. One known method of providing slow pinion rotation is the use of a resistor which energizes the cranking motor to cause slow rotation of the pinion prior to the time that the pinion is meshed with the ring gear. Cranking motor systems that utilize resistors are disclosed in the U.S. Pat. Nos. to Chohan 3,866,960, to Broyden 3,433,968 and to Schneider et al. 2,542,712.

This invention operates to provide slow rotation of the pinion when the pinion is moved toward meshing engagement with the ring gear but does not require an additional resistor to accomplish this. The cranking motor control system of this invention, instead of utilizing an extra resistor controls the energization of the pull-in and hold-in coils in such a manner as to achieve slow initial rotation of the pinion. More specifically, the electric starting system of this invention, instead of energizing both the hold-in and pull-in coils when the starter system is energized, operates initially to only energize the pull-in coil. The starting system is arranged such that when only the pull-in coil is energized sufficient current is supplied to the cranking motor through the pull-in coil to provide a slow rotation of the cranking motor armature and the pinion. The solenoid starter switch of this invention is further arranged such that the solenoid switch contacts are not closed until the pinion has meshed with the ring gear so that full power is not applied to the starting motor until the pinion is meshed with the ring gear. The circuit for the solenoid hold-in coil is so constructed that the hold-in coil is energized via a contact means at approximately the same time that the solenoid switch contacts are closed to energize the cranking motor at full power. It accordingly is an object of this invention to provide an electric starting system whereupon initial energization of the starting motor the hold-in coil is not energized but is energized when the solenoid switch is closed to energize the cranking motor at full power and wherein the motor is energized through the pull-in coil to provide initial slow rotation of the motor armature prior to the time that the pinion is meshed with the ring gear.

IN THE DRAWING

The single figure drawing illustrates an electric starting system made in accordance with this invention.

Referring now to the drawing, the reference numeral 10 generally designates an electric starter which has a 12 volt direct voltage starting or cranking motor 12 and a solenoid 14. The solenoid 14 is secured to the frame of the electric cranking motor 12 in a manner well known to those skilled in the art.

The electric cranking motor has an armature designated by reference numeral 16 which includes the usual armature winding. This motor has means for providing a magnetic field which may be field coils or may be permanent magnets. The means for providing the magnetic field has not been illustrated.

The armature shaft of the cranking motor 12 is designated by reference numeral 26. This armature shaft carries a starter drive generally designated by reference numeral 28 that comprises a pinion 30, an over-running clutch 32, a sleeve 34 and a shift collar 36. The shift collar 36 is fixed to the sleeve 34 and the sleeve 34 and the armature shaft have a cooperating helical or spiral splines (not illustrated) which causes the sleeve 34 to rotate slightly when the shift collar 36 and the sleeve are shifted axially with respect to the shaft 26. Such a splined connection is well known to those skilled in the art, examples being the starter drive arrangements disclosed in the U.S. Pat. Nos. to House et al. 2,902,125 and to Givan 4,573,364.

The sleeve 34 is rigidly connected to the outer clutch shell of the over-running clutch 32 and the pinion 30 is connected to the inner clutch shell of the over-running clutch 32. The over-running clutch may be of the general type disclosed in the above-referenced Pat. No. to House et al. 2,902,125. The starter drive, which includes pinion 30, is adapted to be shifted axially along the armature shaft 26 into mesh with the ring gear 38 of an internal combustion engine 40 in order to crank the engine.

The solenoid 14 has a pull-in coil 42, a hold-in coil 44 and a plunger or armature 46 which is shifted axially when pull-in coil is energized. The plunger 46 operates a movable electrical contactor 48 which is shown fixed to the plunger 46 by electrically insulating material 49. The contactor 48, at times, engages fixed electrical contacts 50 and 52 to bridge or electrically connect these contacts.

The plunger or armature 46 of the solenoid is connected to a rod or link 54 which in turn is connected to a pivotally mounted shift lever 56 which pivots about a pivot 58. One end of the shift lever is coupled in a conventional manner to the shift collar 36 so that pivotal movement of the shift lever 56 will cause the starter drive 28 and pinion to be shifted axially with respect to the shaft 26. When the solenoid pull-in coil 42 is energized the plunger 46 is shifted in a direction to cause the contactor 48 to engage the fixed contacts 50 and 52. This movement of the plunger 46 pivots the shift lever 56 counterclockwise against the force of spring 57 thereby shifting the starter drive 28 in such a direction as to cause the pinion 30 to mesh with the ring gear 38. The linkage connecting the plunger 46 and the pinion 30 is arranged such that the contactor 48 will only engage the fixed contacts 50 and 52 when the pinion 30 is fully meshed with the ring gear 38. Thus, if an end tooth abutment occurs between the ends of the teeth of pinion 30 and the ends of the teeth of ring gear 38 so as to prevent meshing of the pinion 30 with the ring gear 38 the switch contactor 48 will not become engaged with the fixed contacts 50 and 52. In this regard it is noted that parts of the starter drive 28 cannot move axially relative to each other so that when an end tooth abutment occurs the plunger 46 and the shift lever 56 cannot move and accordingly the contactor 48 does not become engaged with the fixed contacts 50 and 52. In this end tooth abutment condition the energized pull-in coil 42 of the solenoid attempts to mesh the pinion with the ring gear and cause the contactor 48 to engage fixed contacts 50 and 52 but such movement is prevented or blocked since the linkage connecting the plunger and the pinion is effectively blocked from movement because of the end tooth abutment. When the coils of the solenoid are deenergized the return spring 57 returns the plunger 46 and pinion to positions illustrated in the drawing. Thus, spring 57 causes the contactor 48 to separate from fixed contacts 50 and 52 and causes the pinion 30 to be pulled out of mesh with ring gear 38.

The system illustrated in the drawing includes a 12 volt direct voltage source which takes the form of a 12 volt battery 60. The negative side of the battery is grounded and the positive side of the battery is connected to the fixed solenoid switch contact 50 by a conductor 62. The other fixed contact 52 of the solenoid switch is connected to one side of the electric cranking motor by a conductor 64. The fixed contact 52 is also connected to one side of the pull-in coil 42 of the solenoid 14.

The system illustrated in the drawing has a manually operable start switch 66, one side of which is connected to the positive side of the battery 60. The opposite side of manually operable switch 66 is connected to junction 68 by conductor 70 and junction 68 is connected to one side of the hold-in coil 44 and to one side of the pull-in coil 42. The opposite side of hold-in coil 44 is connected to a fixed electrical switch contact 72 by conductor 73. The contact 72, together with another fixed contact 74, form fixed solenoid switch contacts. The fixed contact 74 is connected to ground. Contacts 72 and 74 are bridged or electrically connected when they are engaged by a movable contactor 76 that is carried by insulator 49 and accordingly shiftable with plunger 46. The contactor 76 engages fixed contacts 72 and 74 at approximately the same time that contactor 48 engages fixed contacts 50 and 52.

The operation of the starting system of this invention will now be described. Let it be assumed that the operator of a motor vehicle desires to crank the engine to start the engine. The manually operable switch 66 is now closed which energizes the pull-in winding 42 via a circuit that can be traced from conductor 70, through the pull-in coil 42, through conductor 64 and then through the direct voltage cranking motor to ground. When pull-in coil 42 is energized it shifts the plunger 46 to cause the pinion to become meshed with the ring gear 38. It is assumed that an end tooth abutment has occurred such that pinion 30 cannot be meshed with ring gear 38. During such a condition of operation the contact 48 is prevented from engaging fixed contacts 50 and 52 and the contact 76 is prevented from engaging fixed contacts 72 and 74. During this end tooth abutment condition the electric cranking motor 16 is energized through the pull-in coil 42. The resistance of the pull-in coil 42 is selected so as to provide a motor current of a magnitude that causes the motor to develop an output torque which is sufficient to slowly rotate the shaft 26. The resistance of the pull-in coil that is selected will take into account the resistance of the field coils of the motor if field coils are used. Where a permanent magnet field is used the resistance of the pull-in coil will determine the amount of armature current necessary to cause slow rotation of the motor armature. As shaft 26 rotates slowly the teeth of the pinion 30 will eventually be rotated to a position in which they can be meshed with the ring gear 38 and the flux developed by pull-in coil 42 will now cause plunger 46 to be shifted to in turn cause pinion 30 to be meshed with ring gear 38.

When the pinion 30 is meshed with the ring gear 38 the solenoid plunger 46 will have moved to a position in which contactor 48 engages fixed contacts contacts 50 and 52 and contact 76 engages fixed contacts 72 and 74. The pull-in coil 42 is now bypassed or short circuited and full power is applied to the cranking motor via the bridged contacts 50 and 52 with the result that motor speed is increased to the desired engine cranking speed. Moreover, the engagement of contactor 76 with fixed contacts 72 and 74 now causes the hold-in coil 44 to be energized via bridged contacts 72 and 74. The energized hold-in coil 44 now maintains the plunger 46 in a position that maintains the pinion 30 meshed with the ring gear 38 and also maintains the plunger 46 in such a position that the contactors 48 and 76 bridge or connect their respective associated contacts.

It should be noted that each time switch 66 is closed to initiate engine cranking the pull-in coil 42 is energized and the motor is energized through the pull-in coil to cause slow rotation of the motor armature and pinion. Thus, as the pinion is being moved toward the ring gear by energization of coil 42 the armature shaft 26 is being rotated at slow speed. Where there is no end tooth abutment the pinion will mesh with the ring gear and the pinion is rotated slowly prior to meshing engagement with the ring gear.

When it is desired to terminate engine cranking the operator of the motor vehicle opens the switch 66 thereby deenergizing the hold-in coil 44 and the spring 57 pulls the pinion 30 out of mesh with the ring gear 38 and causes the contactors 48 and 76 to become disconnected from their associated fixed contacts.

Further, in regard to the operation of the starting system, the amount of current that can be supplied to the electric starter is limited as to magnitude by the current carrying capability of switch 66 and wiring such as the conductor 62 that connects the battery 60 to fixed contact 50. For example, maximum current that can be handled by the system may be about 70 amps. With such a constraint the entire 70 amps is applied to the pull-in coil 42 and motor when the engine is being cranked. The hold-in coil 44 may, for example, require a current of 15 amps but this 15 amps is not drawn from the battery until contactor 76 engages fixed contacts 72 and 74. Thus, by not not energizing the hold-in coil 44 until the plunger is moved to a position to connect fixed contacts 50 and 52 the total 70 amps can be supplied to the pull-in coil 42 and motor to cause initial slow rotation of the armature shaft 26. Thus, sufficient current may be supplied to the motor to cause it to rotate slowly within the limits of the current carrying capability of the switch 66 and wiring connecting the battery to the starter.

It has been pointed out that contactors 48 and 76 do not bridge or electrically connect their associated fixed contacts until the pinion 30 is fully meshed with ring gear 38. The starter drive 28 accomplishes this because it does not allow relative axial movement between the parts thereof. It will be appreciated by those skilled in the art that other apparatus can be utilized to provide an arrangement in which full power is not supplied to the electric starting motor until the pinion is meshed with the ring gear. Thus, if it were desired to use a jump spring in the starter drive the starter drive could be arranged in a manner disclosed in the U.S. Pat. No. to Schneider et al. 2,862,391 which includes stop members for preventing closure of the solenoid start switch until the pinion is meshed with the ring gear.

The armature of the motor can be arranged to drive the pinion through a gear reduction drive as is disclosed in the above-referenced Givan Pat. No. 4,573,364.

The embodiments of the invention in which an exclusive property or privilege is claimed are defined as follows:

1. An electric starting system for cranking an engine comprising, a source of direct voltage, an electric cranking motor having an armature, a shaft driven by said armature carrying a pinion that is adapted to be meshed with the ring gear of an engine to be cranked, a solenoid having a pull-in coil, a hold-in coil and a shiftable plunger, means connecting said plunger and pinion such that shiftable movement of said plunger causes said pinion to shift, first and second solenoid switch means operated by said plunger, said first and second solenoid switch means being open when said pinion is not meshed with said ring gear and being closed only when said pinion is meshed with said ring gear, a start switch, and a circuit connected across said voltage source comprising in a series connection said start switch, said pull-in coil and said cranking motor whereby when said start switch is closed said pull-in coil and motor are energized, said circuit operative to provide a current to said motor to cause the motor armature to rotate at a slow speed, said first solenoid switch means being so connected with said pull-in coil and motor as to bypass said pull-in coil and connect said motor to said voltage source when said first solenoid switch means is closed whereby the motor is energized at full power to cause said motor armature to rotate at a higher speed, said second solenoid switch means being so connected with said hold-in coil and voltage source that said hold-in coil is energized when said second solenoid switch means is closed.

2. An electric starting system for cranking an engine comprising, a source of direct voltage, an electric cranking motor having an armature, a shaft driven by said armature carrying a pinion that is adapted to be meshed with the ring gear of an engine to be cranked, a solenoid having a pull-in coil, a hold-in coil and a shiftable plunger, means connecting said plunger and pinion such that shiftable movement of said plunger causes said pinion to shift, first and second solenoid switch means operated by said plunger, said first and second solenoid switch means being open when said plunger is in such a position that said pinion is not meshed with said ring gear and being closed only when said plunger is in such a position that said pinion is meshed with said ring gear, said first solenoid switch means comprising first and second fixed contacts that are at times engaged by a contactor that is moved by said plunger, means connecting said first fixed contact to one side of said voltage source, means connecting said second fixed contact to one side of said motor, means connecting the opposite side of said motor to the other side of said source of voltage, a start switch, means connecting said start switch between said one side of said voltage source and one side of said pull-in and hold-in coils, and means connecting the opposite side of said pull-in coil to said second fixed contact, said start switch when closed causing said pull-in coil and motor to be energized with a current of a magnitude to cause the motor armature to rotate at a slow speed, said first solenoid switch means when closed energizing said motor at full power to cause said motor armature to rotate at a higher speed, said second solenoid switch means being so connected with said hold-in coil and voltage source that said hold-in coil is energized when said second solenoid switch means is closed.

* * * * *